United States Patent [19]

Duer

[11] 4,385,545

[45] May 31, 1983

[54] RELOADING DEVICE FOR METALLIC FIREARM CARTRIDGES

[76] Inventor: Morris J. Duer, 8501 Peachwood Dr., Centerville, Ohio 45459

[21] Appl. No.: 299,811

[22] Filed: Sep. 8, 1981

[51] Int. Cl.[3] ..... F42B 33/02

[52] U.S. Cl. ..... 86/28; 86/23; 86/25; 86/32; 86/33; 86/37; 86/43

[58] Field of Search ..... 86/23, 25, 28, 32, 33, 86/36, 37, 43

[56] References Cited

U.S. PATENT DOCUMENTS

| | | | |
|---|---|---|---|
| 3,440,923 | 4/1969 | Purdie | 86/43 |
| 3,745,875 | 7/1973 | Kennedy | 86/23 |
| 3,974,736 | 8/1976 | Minko | 86/36 X |
| 3,979,995 | 9/1976 | Phillips | 86/36 |

FOREIGN PATENT DOCUMENTS

| | | | |
|---|---|---|---|
| 394442 | 1/1909 | France | 86/37 |

*Primary Examiner*—Leland A. Sebastian
*Attorney, Agent, or Firm*—Malcolm R. McKinnon

[57] ABSTRACT

A reloading device for metallic firearm cartridges, the reloading device incorporating improved means for depriming and resizing a previously fired cartridge, thereafter repriming the cartridge and subsequently seating a bullet in the cartridge to a desired controlled depth and, if desired, crimping the cartridge case, said reloading device comprising in combination a hinged, latched, base and cover portion, defining a longitudinally extending passageway, removably containing at each end, respectively, a cartridge holder means and a resizing and depriming means.

18 Claims, 11 Drawing Figures

FIG. 2.
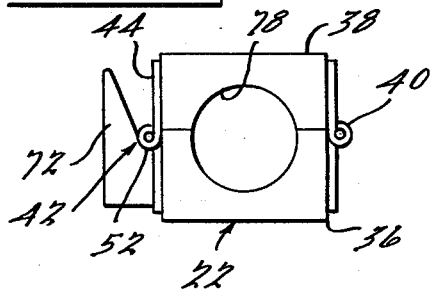
FIG. 3.
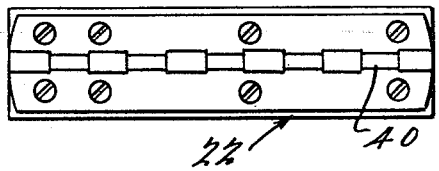
FIG. 1.
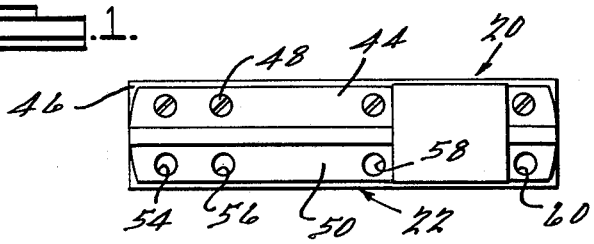
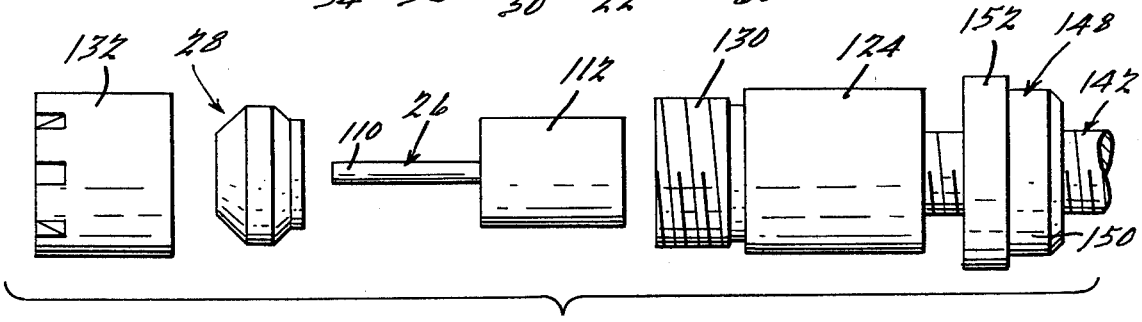
FIG. 5.
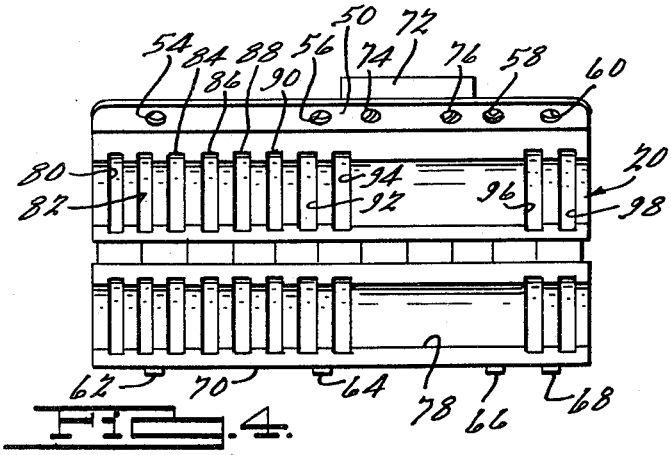
FIG. 4.
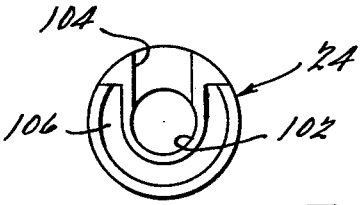
FIG. 6.
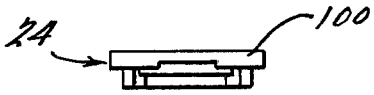
FIG. 7.

RELOADING DEVICE FOR METALLIC FIREARM CARTRIDGES

BRIEF SUMMARY OF THE INVENTION

This invention relates to reloading devices for firearm cartridges and, more particularly, to an improved reloading device for reloading metallic, center fired pistol, rifle and/or shot gun cartridges.

As is well known in the art, heretofore numerous prior devices have been devised and utilized for the purpose of reloading metallic firearm cartridges. The greatest majority of such cartridge reloading devices have been devised for stationary installation and are usually permanently installed on a workbench or other suitable stationary support. However, as is also well known in the art, such stationary installations are relatively heavy and cumbersome and cannot be transported conveniently to a shooting range or into the field. Heretofore, various portable cartridge reloading devices have also been devised which are intended to be transported by the user. However, such prior portable cartridge reloading devices have tended to be relatively complicated and/or expensive, or have been deficient in cartridge reloading capabilities, or have required excessive manual dexterity and skill with the result that prior portable cartridge reloaders have failed to achieve significant acceptance in the marketplace.

An object of the present invention is to overcome disadvantages in prior firearm cartridge reloading devices of the indicated character and to provide an improved firearm cartridge reloading device incorporating improved means for depriming and resizing a previously fired cartridge, thereafter repriming the cartridge, and subsequently seating a bullet in the cartridge to a desired controlled depth, and, if desired, crimping the cartridge case.

Another object of the invention is to provide an improved portable reloading device for metallic firearm cartridges that may be readily transported by the user thereof to a shooting range or in the field whereby the reloading device will be readily available to the user at all desired times and places.

Another object of the present invention is to provide a practical, economical and high quality portable firearm cartridge reloading device having a novel housing provided with a readily accessible interior whereby the interchange of various components is facilitated.

Another object of the invention is to provide an improved firearm cartridge reloading device wherein major reloading operations are accomplished through the agency of manually actuated screws which have adequate power for the duty required but which are also sensitive enough to impart a sense of feel for the various reloading operations.

Another object of the invention is to provide an improved cartridge reloading device that is readily adaptable to reload cartridges of various sizes and wherein the amount of resizing of the cartridges may be accurately and adjustably controlled.

Another object of the invention is to provide an improved firearm cartridge reloading device that is relatively simple in construction, durable, efficient and reliable in operation.

Still another object of the present invention is to provide an improved metallic cartridge reloading device which enables conventional firearm cartridges to be modified in the manner known as wildcatting.

Yet another object of the present invention is to provide an improved metallic cartridge reloading device incorporating improved means for maintaining a cartridge case, the various reloading tools and a bullet in straight line alignment.

The above as well as other objects and advantages of the present invention will become apparent from the following description, the appended claims and the accompanying drawings.

BRIEF DESCRIPTION OF THE DRAWINGS

FIG. 1 is a front elevational view of the support housing of a metallic cartridge reloading device embodying the present invention, the housing being utilized to house and support firearm cartridges and various components of the reloading device during cartridge reloading operations;

FIG. 2 is an enlarged end elevational view of the housing illustrated in FIG. 1;

FIG. 3 is a rear elevational view of the housing illustrated in FIG. 1;

FIG. 4 is an enlarged top plan view of the housing illustrated in FIG. 1, showing the same with the cover portion thereof in the open position;

FIG. 5 is an enlarged, exploded view of the depriming and resizing tools embodied in the present invention;

FIG. 6 is an enlarged, front elevational view of the cartridge holder embodied in the present invention;

FIG. 7 is a top plan view of the cartridge holder illustrated in FIG. 6;

DETAILED DESCRIPTION

Figure 8:
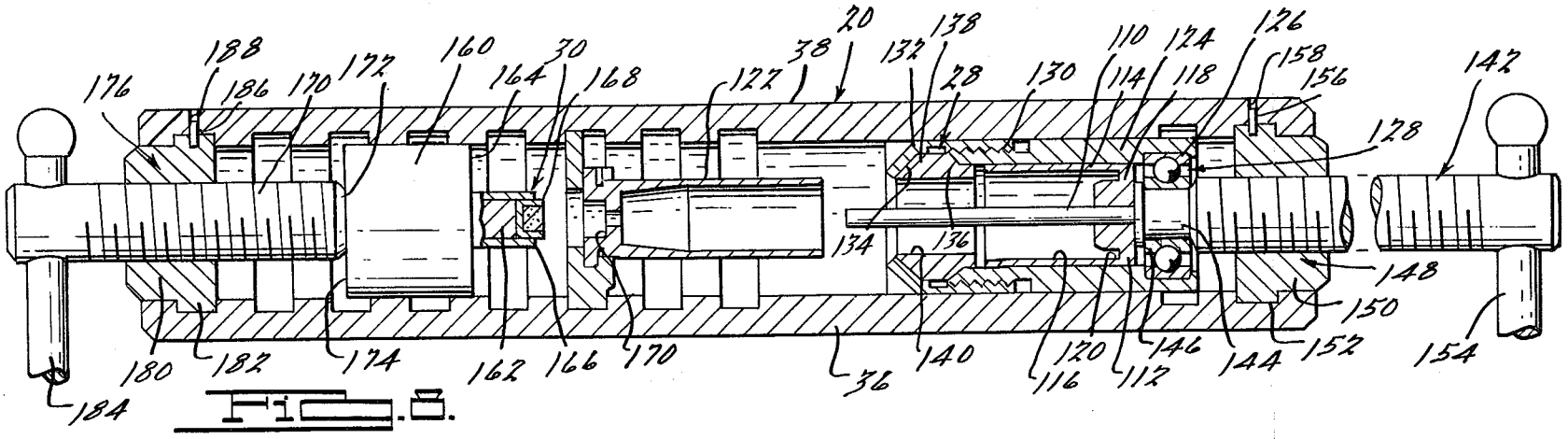
FIG. 8 is an enlarged, longitudinal cross sectional view of the reloading device embodying the present invention as utilized during pistol cartridge depriming, resizing and repriming operations.

Referring to the drawings, a reloading device, generally designated 20, embodying the present invention is illustrated therein, the reloading device 20 being particularly adapted for use in reloading metallic firearm cartridges although it will be understood that the present invention may be utilized for other purposes. In general, the reloading device 20 is comprised of a support housing, generally designated 22, a cartridge holder, generally designated 24, a depriming tool, generally designated 26, a resizing tool, generally designated 28, a repriming tool generally designated 30, a sleeve 32, and a bullet seating and crimping tool, generally designated 34.

Referring in greater detail to the various components of the reloading device 20, the housing 22, which is preferably formed of plastic or other suitable material having sufficient strength to withstand the forces exerted thereon, is comprised of a base portion 36 and a cover portion 38 which are hingedly connected together at the rear thereof by a hinge 40. The base portion 36 and cover portion 38 are adapted to be latched tightly together through the agency of a hinged latch mechanism, generally designated 42, having an upper plate portion 44, as viewed in FIGS. 1 and 2, fixed to the front wall 46 of the cover portion 38 of the housing 22 by screws such as 48. The latch mechanism 42 also includes a lower plate portion 50 hingedly connected to the upper plate portion 44 by a hinge 52, the lower plate portion 50 defining longitudinally spaced holes 54, 56, 58 and 60 adapted to receive pins 62, 64, 66 and 68 projecting outwardly from the front wall 70 of the base portion 36 of the housing 22. The latch mechanism 42 also includes a handle 72 fixed to the lower plate portion 50 as by screws 74 and 76, whereby the latch mechanism may be easily opened and closed manually by pivoting the lower plate portio 50 in the appropriate direction about the longitudinal axis o the hinge 52 relative to the upper plate portion 44. With such a construction, the cover portion 38 may be securely latched to the base portion 36 throughout the length of the housing 22 so as to minimize distortion of the housing during cartridge reloading operations. While the exterior walls of the housing 22 are illustrated as being generally rectangular, it will be understood that such exterior walls may have other configurations. For example, such exterior walls may be curved, and other latch means may be utilized to latch the cover portion to the base portion, preferably throughout the length of the housing.

When the housing 22 is in the closed condition as illustrated in FIGS. 1, 2 and 3, the base and cover portions 36 and 38 of the housing 22 cooperate to define a right circular, cylindrical, longitudinally extending passageway 78 which is open at each end of the housing 22. The base and cover portions 36 and 38 of the housing, in the closed condition, also cooperate to define a plurality of annular grooves 80, 82, 84, 86, 88, 90, 92, 94, 96 and 98 which are spaced longitudinally along the passageway 78 and which extend radially of the cylindrical passageway 78. The grooves 80 through 98 are adapted to receive various components of the reloading device as illustrated in FIGS. 8, 9, 10 and 11 as will be described hereinafter in greater detail.

The base portion 36 of the housing 22 preferably defines slightly more that one hundred and eighty degrees of the circumference of the right circular cylindrical passageway 78 and the associated grooves 80 through 98 as illustrated in FIG. 2, whereby the various components of the reloading device will have a tight spring or snap fit when inserted in the grooves 80 through 98.

As shown in FIGS. 6 through 11, cartridge holders 24 are provided which are adapted to fit in the annular grooves 80 through 94 (the grooves 96 and 98 are not utilized in conjunction with the cartridge holders 24) and hold cartridges of various sizes in coaxial alignment with the longitudinal axis of the passageway 78, the cartridge holder 24 being illustrative of a cartridge holder adapted to hold a pistol or rifle cartridge in the housing 22. It will be understood that the internal dimensions of the cartridge holders may be varied as required to accommodate cartridges of various sizes within the capacity of the reloader 20. As shown in FIGS. 6 through 11, each cartridge holder 24 includes an upstanding circular base portion 100 defining a centrally disposed circular opening 102 extending through the base portion 100. The base portion 100 also defines a radially extending slot 104 communicating with the opening 102. In addition, the cartridge holder includes a general C-shaped retainer portion 106 formed integrally with the base portion 100, the C-shaped retainer portion 106 and base portion 100 cooperating to define a generally hemi-annular slot 108 adapted to receive the rim of a cartridge case, as illustrated in FIGS. 8 through 11, whereby the longitudinal axis of the cartridge case will be disposed in coaxial alignment with the longitudinal axis of the passageway 78 when the cartridge holder 14 is inserted in one of the grooves 80 through 94 as will be described hereinafter in greater detail.

Figure 10:
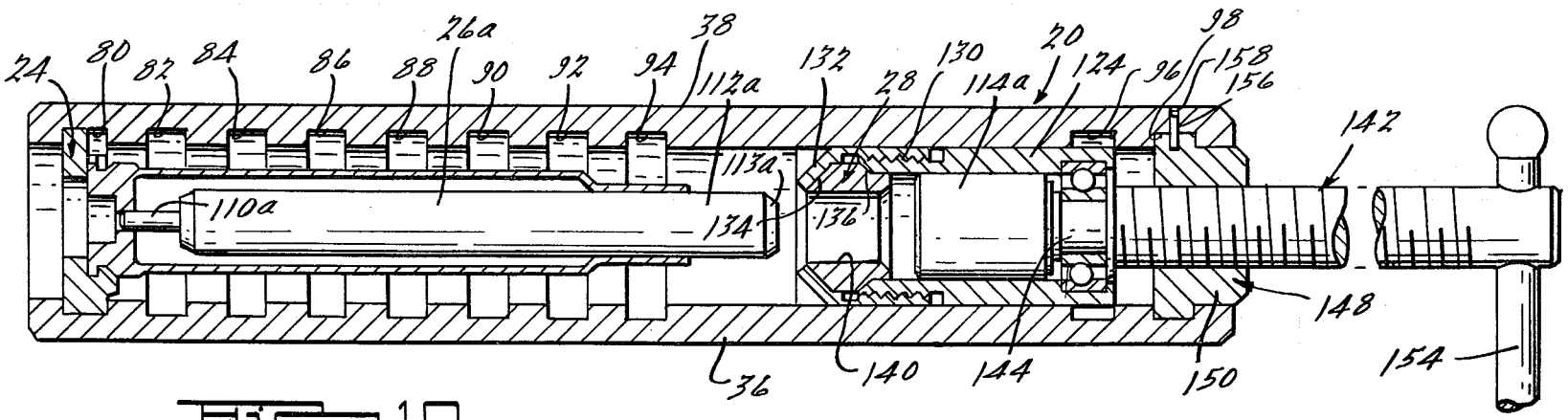
FIG. 10 is an enlarged, longitudinal cross sectional view of the reloading device embodying the present invention as utilized during rifle cartridge depriming and neck resizing operations.

FIGS. 5 through 8 illustrate a depriming tool 26 adapted to deprime a pistol cartridge while FIG. 10 illustrates a depriming tool **26*a* adapted to deprime a rifle cartridge. The depriming tool 26 includes a longitudinally extending pin 110 carried by a base 112 having a circumferential wall 114 defining a passageway 116 closed at the right hand end thereof, as viewed in FIG. 8, by an end wall 118 integral with the circumferential wall 114 and defining an internal annular groove 120 adapted to accommodate the forward end portion of a pistol cartridge case 122**.

The base 112 of the depriming tool 26 is adapted to be received in the tubular body portion 124 of the resizing tool 28 as will be described hereinafter in greater detail.

The depriming tool **26*a* illustrated in FIG. 10 also includes a longitudinally extending pin 110*a* carried by an elongated cylindrical base 112*a*, the end portion 113*a* of the base 112*a* remote from the pin 110*a* being adapted to engage a metal or plastic slug 114*a* disposed in the tubular body portion 124** of the resizing tool.

The resizing tool 28 includes the tubular body 124, one end portion of which is mounted on the outer race 126 of a bearing 128, such end portion of the tubular body 124 being circular in transverse cross section and having an easy sliding fit in the passageway 78. The other end portion of the tubular body 124 is provided with an external thread 130 adapted for threaded engagement with an internally threaded retaining cap 132. The retaining cap 132 and the tubular body 124 are provided with oppositely inclined shoulders 134 and 136, respectively, between which is disposed a resizing die 138 which is preferably formed of a softly resilient, strong material having a low coefficient of friction, such as Nylon or Teflon. The resizing die defines an internal passageway 140, and the internal diameter of the resizing die may be adjusted within limits by adjusting the compressive forces applied to the opposite ends of the die by the inclined shoulders 134 and 136 as the internally threaded retaining cap 132 is advanced or retracted on the external thread 130 of the tubular body 124. For example, the compressive forces applied to the resizing die by the inclined shoulders 134 and 136 are increased as the retaining cap 132 is screwed onto the tubular body 124 with the result that the internal diameter of the resizing die is reduced whereby the amount of resizing of the cartridge case may be controlled as will be described hereinafter in greater detail.

The resizing and depriming tools 26 and 28 are advanced and retracted in the passageway 78 through the agency of an externally threaded actuating member 142, one end portion 144 of which is fixed to the inner race 146 of the bearing 128. The externally threaded actuating member 142 extends through and threadably engages a nut 148 having a cylindrical main body portion 150 adapted to fit into the passageway 78 and a radially projecting flange portion 152 adapted to fit into the annular groove 98 defined by the housing 22. The outer end of the actuating member 142 is provided with a conventional handle 154 which facilitates the manual application of torque to the actuating member 142 whereby the resizing die and the depriming tool may be advanced and retracted relative to the cartridge case 122. A pin 156 is provided which projects radially from the flange 152 of the nut 148 into a hole 158 provided in the housing 22 to prevent rotation of the nut 148 relative to the housing 22 when torque is applied to the actuating member 142.

The repriming tool 30 includes a cylindrical body 160 which is circular is transverse cross section and which has an easy sliding fit in the passageway 78. A cylindrical boss 162 is provided on the body 160, the boss 162 projecting axially from the end 164 of the body 162. A resilient cylindrical tube 166 is provided which is preferably formed of relatively soft rubber, such as surgical tubing or similar material, and one end portion of the tube 166 is mounted on the boss 162. The internal diameter of the tube 166 is slightly smaller than the outside diameter of the primer 168 which is to be inserted in the cartridge whereby the tube 166 is adapted to hold the primer until seating of the primer is initiated in the cartridge case after which the tube 166 recedes and the boss 162 pushes the primer directly into the primer pocket 170 of the cartridge case. An important advantage of the aforementioned construction resides in the fact that the rubber tube 166 facilitates picking up primers without contact with the users' fingers, it having been found that a minor trace of natural oil from human hands can adversely affect primer performance.

The body 160 together with the boss 162 and tube 166 are advanced in the passageway 78 by means of an externally threaded actuating member 170 one end portion 172 of which bears against the end 174 of the body 160 whereby the body 160 may be advanced in the passageway 78 without rotation of the body relative to the housing 22. Thus, the primer is inserted into the cartridge case without relative rotation of the primer relative to the cartridge case.

The externally threaded actuating member 170 extends through and threadably engages a nut 176 which is similar to the nut 148 and which includes a cylindrical body portion 180 adapted to fit in the passageway 78 and a radially projecting flange portion 182 adapted to fit into the annular grooves, such as the groove 80 defined by the housing 22. The outer end of the actuating member 170 is also provided with a conventional handle 184 which facilitates manual application of torque to the actuating member whereby the body 160 may be advanced toward the cartridge case. A pin 186 is also provided which projects radially from the flange 182 into a hole 188 provided in the housing 22 to prevent rotation of the nut 176 relative to the housing 22 when torque is applied to the actuating member 170.

The bullet seating and crimping tool 34 includes an externally threaded actuating member 190 which extends through and threadably engages a nut 192 which is similar to the nuts 148 and 176 and which also includes a cylindrical body portion 194 adapted to fit in the passageway 78 and a radially projecting flange portion 196 adapted to fit in the annular grooves defined by the housing 22, such as the groove 98. The outer end portion of the actuating member 190 is also provided with a conventional handle 198 which facilitates the manual application of torque to the actuating member whereby the actuating member may be advanced toward the cartridge case, a pin 200 being provided which projects into the hole 158 provided in the housing 22 to prevent rotation of the nut 192 relative to the housing 22 when torque is applied to the actuating member 190.

The actuating member 190 serves to advance and retract a bullet seating punch 202 having a shank portion 204 defining a recess 206 at the forward end thereof shaped to conform to the shape of the nose of the bullet being seated. The punch also includes a radially extending flange portion 208 and a reduced diameter end portion 210 terminating in a generally conically shaped pointed section 212 which bears against a jewel type thrust bearing 214 disposed between the conically shaped end of the punch and the adjacent end of a counterbore 216 provided in the actuating member and adapted to receive the reduced diameter end portion 210 of the bullet seating punch.

The seating depth of the bullet is controlled by a jam nut 218 having a skirt portion 220 which threadably engages the actuating member and a radially inwardly projecting flange portion 222 defining a passageway 224 through which the shank portion 204 of the bullet seating punch projects, the jam nut being fixed in the desired axially adjusted position on the actuating member through the agency of set screws 226 and 228. The flange portion 208 of the punch is thus loosely disposed in the space between the flange 222 and the end 230 of the actuating member whereby the punch is loosely guided but rotation of the punch is prevented by the jewel type thrust bearing 214. It has been found that rotation of the bullet punch on the nose of a soft bullet often causes distortion and even destruction of the bullet nose.

The cylindrical sleeve 32 is shaped to conform to the particular cartridge case and particular bullet being reloaded into such cartridge case, the cylindrical sleeve having two internal diameters which are concentric with each other and which very closely fit the cartridge and bullet, respectively. This positive and accurate alignment of the bullet and cartridge case during the bullet seating operation is a very desirable feature for providing maximum product quality. The sleeve also serves to confine the cartridge case during the bullet seating operation whereby expansion of the cartridge case beyond its elastic limit is prevented as the bullet is inserted into the cartridge case.

Crimping may be accomplished, if desired, by the application of additional pressure from the jam nut to the adjacent end of the cylindrical sleeve, the section between the two aforementioned internal diameters of the sleeve being tapered as at 232 at the cartridge case mouth whereby such tapered section causes the case to crimp smoothly into the bullet cannelure.

Figure 9:
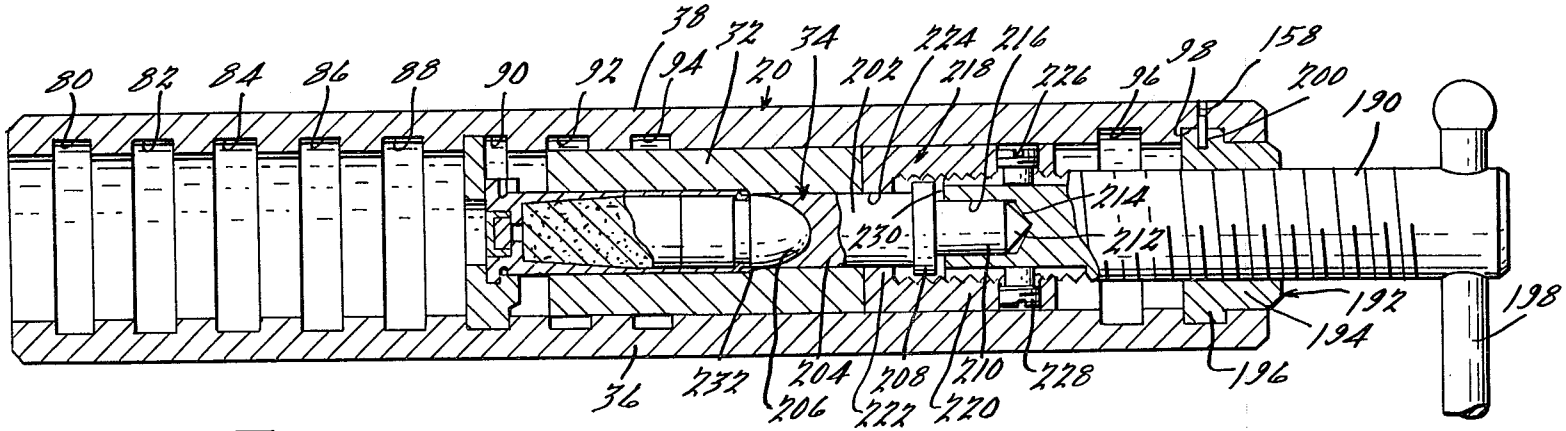
FIG. 9 is an enlarged, longitudinal cross sectional view of the reloading device embodying the present invention as utilized during pistol cartridge bullet seating and crimping operations.
Figure 11:
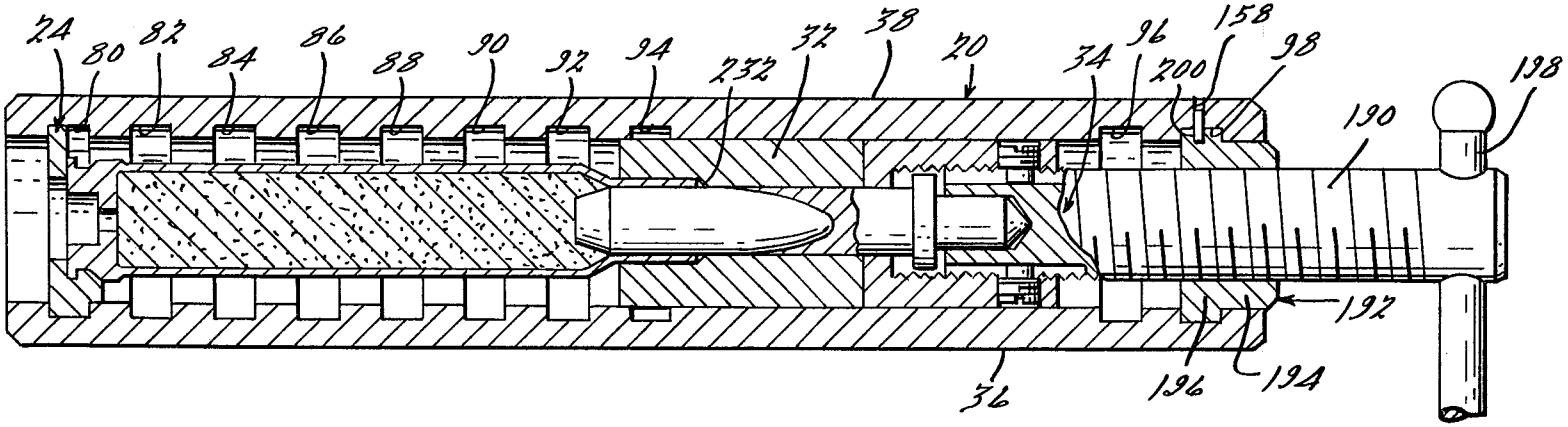
FIG. 11 is an enlarged, longitudinal cross sectional view of the reloading device embodying the present invention as utilized during rifle cartridge bullet seating and crimping operations.

FIG. 9 illustrates the configuration of a bullet seating punch and sleeve intended for use with a pistol cartridge and pistol bullet, while FIG. 11 illustrates the configuration of a seating punch and sleeve intended for use with a rifle cartridge and rifle bullet.

In the operation of the reloading device 20, when it is desired to reload a metallic firearm cartridge, as for example, a pistol or rifle cartridge, the rim of the cartridge is inserted in the slot 108 of a cartridge holder 24 of a size adapted to hold such cartridge in the manner previously described, and, with the cover portion 38 of the housing 22 in the open position, the cartridge holder 24 is then inserted in one of the annular grooves 80 through 94. For example, a cartridge holder for a 38 special pistol cartridge can be inserted in the groove 90 so that the pistol cartridge will be disposed in an appropriate position within the housing 22 relative to the depriming, resizing and bullet seating and crimping tools, while a cartridge holder for a 300 Weatherby magnum rifle cartridge can be inserted initially in the groove 80 during the resizing and depriming operations, moved to the groove 90 during the repriming operation, and then moved back to the groove 80 during the bullet seating and crimping operations whereby the rifle cartridge will thus be disposed in the appropriate position within the housing 22 relative to the depriming, resizing and bullet seating and crimping tools during the operation of such tools.

The base, such as the base 112 of the depriming tool 26, is then inserted in the tubular body portion 124 of the resizing tool 28, and the flange portion 152 of the but 148 is inserted in the groove 98. The cover portion 38 of the housing 22 is then closed and latched to the base portion 36 of the housing through the agency of the hinged latch mechanism 42 previously described. The depriming and resizing tools 26 and 28 are then advanced into engagement with the cartridge by applying torque to the actuating member 142 by manually rotating the handle 154 about the longitudinal axis of the actuating member 142. Resizing and depriming of the cartridge are thus effected simultaneously. As the resizing die 138 traverses the cartridge case, the pin 110 expels the used primer from the cartridge. The amount of resizing of the cartridge case is controlled by adjusting the internal diameter of the die 138 by adjusting the compressive forces applied to the opposite ends of the die by the inclined shoulders 134 and 136 as the internally threaded retaining cap 132 is advanced or retracted on the external thread 130 of the tubular body 124. The die 138 being constructed, for example, of nylon or teflon, has a very low coefficient of friction and does not require lubrication. It has been found desirable however to polish the mouth of the cartridge case with a material such as "Bright Stick" or other polishing material to prevent scratching or cutting of the die material.

The die 138, being adjustable and softly resilient, does not cause excessive material working or abrasion of the cartridge case. This fact, plus the short coupled accurate alignment of the components involved, produces an improved quality of product unattainable by prior art devices.

It will be understood by those skilled in the art that conversion to other calibers may be readily accomplished by simply changing the resizing die, retaining cap and the depriming punch to the appropriate size as illustrated, for example, in FIGS. 10 and 11.

The repriming function is accomplished simply by inserting a new primer in the end of the tube 166 in the manner previously described. The cover portion of the housing 22 is then opened, the flange portion 182 of the nut 176 is inserted in the groove 80, and the cover portion of the housing is again latched in the closed position after which the body 160 together with the boss 162 and tube 166 are advanced in the passageway 78 by means of the actuating member 170 and associated handle 184 so as to insert the primer into the primer pocket 170 of the cartridge case in the manner previously described.

After the depriming, resizing and repriming operations have been accomplished, the cover portion 38 of the housing is again opened, and the depriming, resizing and repriming tools are removed from the housing. The cartridge case is then filled with powder to the desired level, the butt end portion of a new bullet is partially inserted into the mouth of the cartridge, the sleeve 32 is fitted over the filled cartridge, and the flange portion 196 of the nut 192 of the bullet seating and crimping tool 34 is inserted in the groove 98 of the housing. The cover portion of the housing is then latched to the base of the housing in the manner previously described, after which the bullet seating punch 202 is advanced to seat the bullet in the cartridge by applying torque to the actuating member 190 through the agency of the handle 198, the seating depth of the bullet in the cartridge being controlled by the jam nut 218 in the manner previously described. During the bullet seating operation, the entire reloading device 20 may be manually vibrated and turned end for end so that the powder flows within the case along the sides of the butt end portion of the bullet whereby better packing of the powder and maximum density of the powder within the cartridge is achieved.

As previously mentioned, if desired, crimping may be accomplished by the application of additional pressure from the jam nut 218 to the adjacent end of the sleeve 32 whereby the tapered section 232 causes the case to crimp smoothly into the bullet cannelure.

While preferred embodiments of the invention have been illustrated and described, it will be understood that various changes and modifications may be made without departing from the spirit of the invention.

What is claimed is:

1. A reloading device for metallic firearm cartridges, said reloading device comprising, in combination, a housing including a base portion and a cover portion, said base and cover portions cooperating to define a longitudinally extending passageway open at each end, said base and cover portions also cooperating to define a plurality of annular grooves spaced longitudinally of the passageway defined by said base and cover portions, means hingedly connecting said base portion and said cover portion along one side thereof, means for latching said base and cover portions tightly together along the other side thereof, cartridge holder means insertable in the annular grooves defined by said housing, cartridge resizing means insertable in the passageway defined by said housing and supportable by said housing, and means for manually advancing and retracting said resizing tool in the passageway defined by said housing.

2. The combination as set forth in claim 1 including cartridge depriming means carried by said resizing means and movable simultaneously with said resizing means.

3. The combination as set forth in claim 1, said base portion of said housing defining slightly more than one hundred and eighty degrees of the circumference of the passageway defined by said base and cover portions.

4. The combination as set forth in claim 1, said resizing means including an adjustable resizing die formed of softly resilient, strong material having a low coefficient of friction.

5. The combination as set forth in claim 1, said means for manually advancing and retracting said resizing tool including an externally threaded actuating member projecting axially from one end portion of said housing, and means for applying torque to said actuating member.

6. A reloading device for metallic firearm cartridges, said reloading device comprising, in combination, a housing including a base portion and a cover portion, said base and cover portions cooperating to define a longitudinally extending passageway open at each end, said base and cover portions also cooperating to define a plurality of annular grooves spaced longitudinally of the passageway defined by said base and cover portions, means hingedly connecting said base portion and said cover portion along one side thereof, means for latching said base and cover portions tightly together along the other side thereof, cartridge holder means insertable in the annular grooves defined by said housing, repriming means insertable in the passageway defined by said housing and supportable by said housing, said repriming means including a cylindrical body having an easy sliding fit in the passageway defined by said housing, a boss projecting axially from one end of said body, and a resilient cylindrical tube formed of relatively soft material, one end portion of said tube being mounted on said boss, the other end portion of said tube being adapted to hold a cartridge primer, and means for manually advancing said repriming means in the passageway defined by said housing.

7. The combination as set forth in claim 6, said means for manually advancing said repriming means including an externally threaded actuating member projecting axially from one end portion of said housing, and means for applying torque to said actuating member.

8. A reloading device for metallic firearm cartridges, said reloading device comprising, in combination, a housing including a base portion and a cover portion, said base and cover portions cooperating to define a longitudinally extending passageway open at each end, said base and cover portions also cooperating to define a plurality of annular grooves spaced longitudinally of the passageway defined by said base and cover portions, means hingedly connecting said base portion and said cover portion along one side thereof, means for latching said base and cover portions tightly together along the other side thereof, cartridge holder means insertable in the annular grooves defined by said housing, bullet seating means insertable in the passageway defined by said housing and supportable by said housing, said bullet seating means including a seating punch defining a recess at one end thereof shaped to conform to the shape of the nose of a bullet, means for manually advancing said seating means in the passageway defined by said housing, and means for limiting movement of said seating means longitudinally of said passageway.

9. The combination as set forth in claim 8 including a sleeve disposed in the passageway defined by said housing and adapted to confine a cartridge case during the seating of a bullet in such cartridge case.

10. The combination as set forth in claim 9, said sleeve having two internal diameters concentric with each other, the section of the sleeve between said two internal diameters being tapered.

11. In a reloading device for metallic firearm cartridges, the combination including a housing having a base portion and a cover portion, said base and cover portions cooperating to define a longitudinally extending cylindrical passageway open at each end, said base and cover portions also cooperating to define a plurality of annular grooves spaced longitudinally of the passageway defined by said base and cover portions and extending radially of the cylindrical passageway defined by said base and cover portions, means for releasably latching said base and cover portions tightly together, cartridge holder means insertable in the annular grooves defined by said base and cover portions, cartridge resizing means insertable in the passageway defined by said base and cover portions and supportable by said base and cover portions, said cartridge resizing means including a resizing die formed of softly resilient material having a low coefficient of friction and defining an internal passageway, means for applying compressive forces to the opposite ends of said die to vary the internal diameter of said die, and means for manually advancing said die in the passageway defined by said housing.

12. The combination as set forth in claim 11 including cartridge depriming means carried by said resizing means and projecting through said resizing die.

13. The combination as set forth in claim 11, said base portion of said housing defining slightly more than one hundred and eighty degrees of the circumference of the passageway defined by said base and cover portions.

14. The combination as set forth in claim 11, said cartridge holder means including a base portion defining a centrally disposed opening extending through said base portion, said base portion also defining a radially extending slot communicating with the opening defined by said base portion, said cartridge holder means also including a generally C-shaped retainer portion formed integrally with said base portion, said retainer portion and said base portion cooperating to define a generally hemi-annular slot adapted to receive the rim of a cartridge case whereby the longitudinal axis of the cartridge case will be disposed in coaxial alignment with the longitudinal axis of the passageway defined by said housing when said base portion is inserted in an annular groove defined by said base and cover portions.

15. In a reloading device for metallic firearm cartridges, the combination including a housing having a base portion and a cover portion, said base and cover portions cooperating to define a longitudinally extending cylindrical passageway open at each end, said base and cover portions also cooperating to define a plurality of annular grooves spaced longitudinally of the passageway defined by said base and cover portions and extending radially of the cylindrical passageway defined by said base and cover portions, means for releasably latching said base and cover portions tightly together, cartridge holder means insertable in the annular grooves defined by said base and cover portions, bullet seating means insertable in the passageway defined by said base and cover portions and supportable by said base and cover portions, said bullet seating means including a seating punch defining a recess at one end thereof shaped to conform to the shape of the nose of a bullet, means for manually advancing said seating means in the passageway defined by said base and cover portions without rotation of said seating means relative to said base and cover portions, and means for limiting the longitudinal movement of said seating means in the passageway defined by said base and cover portions.

16. The combination as set forth in claim 15 including a sleeve disposed in the passageway defined by said base and cover portions, said sleeve being adapted to confine a cartridge case during movement of said seating means in the passageway defined by said base and cover portions.

17. The combination as set forth in claim 16, said sleeve defining two internal diameters concentric with each other, the section of the sleeve between said two internal diameters being tapered.

18. In a reloading device for metallic firearm cartridges, the combination including a housing having a base portion and a cover portion, said base and cover portions cooperating to define a longitudinally extending cylindrical passageway open at each end, said base and cover portions also cooperating to define a plurality of annular grooves spaced longitudinally of the passageway defined by said base and cover portions and extending radially of the cylindrical passageway defined by said base and cover portions, said base portion defining slightly more than one hundred and eighty degrees of the circumference of the passageway defined by said base and cover portions, means hingedly connecting said base portion and said cover portion along one side thereof, means for releasably latching said base and cover portions tightly together along the other side thereof, cartridge holder means insertable in the annular grooves defined by said base and cover portions, said cartridge holder means including a base defining a centrally disposed opening extending through said base, said base also defining a radially extending slot communicating with the opening defined by said base, said cartridge holder means also including a generally C-shaped retainer portion formed integrally with said base, said retainer portion and said base cooperating to define a generally hemi-annular slot adapted to receive the rim of a cartridge case whereby the longitudinal axis of the cartridge case will be disposed in coaxial alignment with the longitudinal axis of the passageway defined by said base and cover portions of said housing when said base of said cartridge holder is inserted in an annular groove defined by said base and cover portion, cartridge resizing means insertable in the passageway defined by said base and cover portions and supportable by said base and cover portions, said cartridge resizing means including a resizing die formed of softly resilient material having a low coefficient of friction and defining an internal passageway, means for applying compressive forces to the opposite ends of said die to vary the internal diameter of said die, means for manually advancing said die in the passageway defined by said base and cover portions, cartridge depriming means carried by said resizing means and projecting through said resizing die, means for manually advancing said resizing means and said depriming means in the passageway defined by said base and cover portions, repriming means insertable in the passageway defined by said base and cover portions and supportable by said base and cover portions of said housing, said repriming means including a cylindrical body having an easy sliding fit in the passageway defined by said base and cover portions, a boss projecting axially from one end of said body, and a resilient cylindrical tube formed of relatively soft material, one end portion of said tube being mounted on said boss, the other end portion of said tube being adapted to hold a cartridge primer, means for manually advancing said repriming means in the passageway defined by said base and cover portions, and bullet seating means insertable in the passageway defined by said base and cover portions and supportable by said base and cover portions, said bullet seating means including a seating punch defining a recess at one end thereof shaped to conform to the shape of the nose of a bullet, means for manually advancing said seating means in the passageway defined by said base and cover portions, means for limiting movement of said seating means longitudinally of said passageway, said means for limiting movement of said seating means including a sleeve disposed in the passageway defined by said base and cover portions of said housing and adapted to confine a cartridge case during movement of said seating means longitudinally of said passageway, said sleeve having two internal diameters concentric with each other, the section of the sleeve between said two internal diameters being tapered.

* * * * *